US009656275B2

(12) United States Patent
Ooyama et al.

(10) Patent No.: US 9,656,275 B2
(45) Date of Patent: May 23, 2017

(54) CENTRIFUGE HAVING A STOPPING STEP BETWEEN CENTRIFUGING STEPS

(71) Applicant: HITACHI KOKI CO., LTD., Tokyo (JP)

(72) Inventors: Hisanobu Ooyama, Ibaraki (JP); Kahoru Takahashi, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 110 days.

(21) Appl. No.: 14/573,419

(22) Filed: Dec. 17, 2014

(65) Prior Publication Data

US 2015/0174592 A1 Jun. 25, 2015

(30) Foreign Application Priority Data

Dec. 19, 2013 (JP) ..... 2013-262326

(51) Int. Cl.

| | |
|---|---|
| ***B04B 7/06*** | (2006.01) |
| ***B04B 13/00*** | (2006.01) |
| ***B04B 11/00*** | (2006.01) |
| ***B04B 15/08*** | (2006.01) |
| *B04B 7/02* | (2006.01) |

(52) U.S. Cl.

CPC ..... *B04B 13/00* (2013.01); *B04B 7/06* (2013.01); *B04B 11/00* (2013.01); *B04B 15/08* (2013.01); *B04B 2007/025* (2013.01)

(58) Field of Classification Search

CPC ..... B04B 7/02; B04B 2007/025; B04B 13/00; B04B 5/02; B04B 7/06

USPC ..... 494/7–11, 16–21, 84; 700/273; 422/72; 210/85, 143

See application file for complete search history.

(56) References Cited

U.S. PATENT DOCUMENTS

| | | | | |
|---|---|---|---|---|
| 5,287,265 | A * | 2/1994 | Hall | B04B 13/00 494/10 |
| 5,675,519 | A * | 10/1997 | Yotsuyanagi | B04B 13/00 494/10 |
| 5,871,435 | A * | 2/1999 | Numata | B04B 13/00 494/10 |
| 6,679,821 | B1 * | 1/2004 | Numata | B04B 13/00 494/10 |
| 8,409,068 | B2 * | 4/2013 | Akatsu | B04B 15/08 494/1 |
| 9,393,577 | B2 * | 7/2016 | Hodotsuka | B04B 9/10 |

(Continued)

FOREIGN PATENT DOCUMENTS

| | | | |
|---|---|---|---|
| EP | 344453 | A2 * | 12/1989 |
| JP | 2008-100124 | A | 5/2008 |

*Primary Examiner* — Charles Cooley

(74) *Attorney, Agent, or Firm* — Kenealy Vaidya LLP

(57) ABSTRACT

A centrifuge including a rotor, a rotor chamber accommodating therein the rotor and having an opening, a motor configured to rotate the rotor, a door configured to close the opening of the rotor chamber, an input unit configured to receive an input of an operation condition, a display unit configured to display an operating status, and a control unit configured to control rotation of the motor, wherein the control unit is configured to perform a program operation under an operation condition including a plurality of steps, and wherein the control unit is configured so that a specific step of stopping the rotation of the rotor and permitting the door to be opened or closed can be set as at least one of the plurality of steps.

12 Claims, 8 Drawing Sheets

(56) References Cited

U.S. PATENT DOCUMENTS

| | | | | |
|---|---|---|---|---|
| 9,433,948 | B2 * | 9/2016 | Kusumoto | B04B 15/02 |
| 9,517,476 | B2 * | 12/2016 | Ooyama | B04B 9/10 |
| 9,517,477 | B2 * | 12/2016 | Takahashi | B04B 13/00 |
| 2003/0199379 | A1 * | 10/2003 | Schneider | B04B 13/00 494/11 |
| 2005/0153823 | A1 * | 7/2005 | Fujimaki | B04B 5/0414 494/7 |
| 2006/0166801 | A1 * | 7/2006 | Takahashi | B04B 7/06 494/12 |
| 2006/0178253 | A1 * | 8/2006 | Takahashi | B04B 7/06 494/12 |
| 2007/0149378 | A1 * | 6/2007 | Takahashi | B04B 13/00 494/1 |
| 2011/0059835 | A1 * | 3/2011 | Takahashi | B04B 9/10 494/10 |
| 2011/0207590 | A1 * | 8/2011 | Ooyama | B04B 9/10 494/9 |
| 2011/0230327 | A1 * | 9/2011 | Takahashi | B04B 13/00 494/10 |
| 2012/0260687 | A1 * | 10/2012 | Inaniwa | B04B 9/10 62/196.1 |
| 2014/0031191 | A1 * | 1/2014 | Inaniwa | B04B 9/10 494/9 |
| 2015/0174590 | A1 * | 6/2015 | Ohkawara | B04B 13/00 494/10 |
| 2015/0174592 | A1 * | 6/2015 | Ooyama | B04B 11/00 494/10 |

* cited by examiner

PRIOR ART

CENTRIFUGE HAVING A STOPPING STEP BETWEEN CENTRIFUGING STEPS

CROSS-REFERENCE TO RELATED APPLICATIONS

This application claims priority from Japanese Patent Application No. 2013-262326 filed on Dec. 19, 2013, the entire contents of which are incorporated herein by reference.

TECHNICAL FIELD

Aspects of the present invention relate to a centrifuge configured to separate a sample in fields of medical sciences, pharmaceuticals, biotechnologies and the like, and particularly, to a centrifuge configured to control an operation of a vacuum pump depending on rotation conditions, thereby saving the energy.

BACKGROUND

A centrifuge (a centrifugal separator) is to separate and refine a sample held in a rotor by putting a sample to be separated into a tube or bottle, loading the same to a rotor, accommodating the rotor in a rotor chamber, sealing the rotor chamber and rotating the rotor at high speed. The rotating speed of the rotor is different depending on utilities. A product group having a wide range of rotating speeds, such as a product having a relatively low speed of thousands of revolutions per minute (rpm), which is the maximum rotating speed, and a product having a high speed of about 150,000 revolutions per minute (rpm), which is the maximum rotating speed, is generally supplied. Among of them, a centrifuge having a rotating speed of about 40,000 rpm or higher is provided with a vacuum pump configured to decompress the rotor chamber so as to suppress windage loss (frictional heat) between air in the rotor chamber and the rotor. In general, the vacuum pump consists of an oil rotary vacuum pump functioning as a roughing vacuum pump and an oil diffusion vacuum pump for securing higher vacuum. Further, a cooling device configured to cool the rotor chamber is provided so as to keep the rotor at a preset temperature.

In the centrifuge of the related art, the rotor is detachably mounted to a driving shaft. A user sets a sample container having a sample therein to the detached rotor, covers an opening of the rotor with a cover and then mounts the rotor to the driving shaft in the rotor chamber. In the centrifugal separation operation, it may be necessary to perform a plurality of operations for one specimen at operation conditions having different rotating speeds, for example, in some cases. Further, in some cases, the centrifuge under operation may be stopped to extract or add the sample and the repetition operations may be then performed. A centrifuge is known which has a program operation function capable of automatically switching the operation conditions to perform a step operation. The program operation function is a function of dividing the centrifugal separation operation into a plurality of steps, setting the operation conditions (a rotating speed, time, a temperature and the like) of the centrifuge for each step and automatically operating the set steps in order by a control unit.

JP-A-2008-100124 discloses a technology of implementing the centrifuge program function. According to JP-A-2008-100124, in a case of performing a step operation (a program operation) of continuously operating a centrifuge at operation conditions of a plurality of steps, after inputting step operation conditions by a key input unit, the step operation conditions are displayed on a display unit in a form of a line graph where a rotating speed is displayed on a vertical axis and operating time is displayed on a horizontal axis. However, even when the program operation is performed using the technology of JP-A-2008-100124, there is an inconvenient case when a special centrifugal separation operation is performed. This case is shown in FIG. 12. FIG. 12 illustrates a centrifugal operation including processes of stopping the rotation of the rotor during the entire centrifugal separation operation and adding a sample in a container for specimen. Here, a series of operations of performing a program 01, adding a sample 1, performing a program 02, adding a sample 2 and again performing the program 01 are executed using the technology of JP-A-2008-100124. Here, at time t1, the sample is set to the centrifuge, the program 01 is invoked and an operation is activated by a START button. By a set step function (the program operation function), after STEP 1 (S1) and STEP 2 (S2), the rotor is decelerated and stopped. Here, the user records the operation completion of the program 01 (first) in a notebook and the like. Then, the user presses a vacuum button to stop the vacuum pumps, opens the rotor cover by opening a centrifuge door, supplies the sample into the specimen container, again closes the rotor cover, closes the centrifuge door, invokes the program 02 and pushes the START button at time t4 to start the operation.

Like the program 01, when STEP 3 (S3) and STEP 4 (S4) are operated by the set step function, the rotor is decelerated and stopped. Here, the user records the operation completion of the program 02 (second) in the notebook and the like. Then, the user presses the vacuum button to stop the vacuum pumps, opens the rotor cover by opening the centrifuge door, supplies the sample into the specimen container, closes the rotor cover, closes the centrifuge door, again invokes the program 01 and pushes the START button at time t7 to start the operation. After STEP 1 (S1) and STEP 2 (S2) of the program 01 (second time) are operated, the rotor is decelerated and stopped. Therefore, the user records the operation completion of the program 01 (second) in the notebook and the like, and presses the vacuum button to stop the vacuum pumps, so that the centrifugal separation operation of all processes is over.

SUMMARY

According to the technology of JP-A-2008-100124, when it is necessary to stop the rotor during the centrifugal separation operation, as shown in FIG. 12, it is required to prepare a plurality of programs. For example, at time t4 and time t7, after performing the processing of adding the sample, and the like, it is necessary to invoke the next programs 02, 01 from the operation unit and to manually start the program operation. That is, it is necessary for the user to carefully perform the operation because it is not possible to introduce the stop state (the rotation number: 0) of the rotor into the program operation function. In particular, when repeatedly operating the program 01 and the program 02 many times, the user should record what times the operation is repeatedly performed. Therefore, it is required to further improve the operability. Furthermore, according to the method of the related art, the state of the centrifuge between the programs is unclear, so that the non-uniformity may occur in an analysis result. For example, the information such as the recording of the time from time t3 to time t4, the temperature in the rotor, a degree of vacuum in the rotor chamber, the vibration applied to the rotor, and the like is not sufficiently managed, so that the reproducibility of the operations in accordance with the same sequence may be poor.

It is therefore an object of the present invention to implement a centrifuge capable of setting a specific step, in which operations of stopping rotation of a rotor and extracting or adding a sample are performed, in a program operation function to collectively execute and manage all processes of a centrifugal separation with one program in a centrifugal separation process for one specimen.

Another object of the present invention is to provide a centrifuge enabling a user to easily discriminate a progressing status of a plurality of steps including a specific step for performing sample addition on a screen.

Still another object of the present invention is to provide a centrifuge enabling a user to easily know a start predicted time of a specific step for performing sample addition and the like and a processing content of the specific step.

Representative features of the present invention disclosed in the specification are described, as follows.

According to an aspect of the present invention, there is provided a centrifuge including: a rotor; a rotor chamber accommodating therein the rotor and having an opening; a motor configured to rotate the rotor; a door configured to close the opening of the rotor chamber; an input unit configured to receive an input of an operation condition; a display unit configured to display an operating status; and a control unit configured to control rotation of the motor, wherein the control unit is configured to perform a program operation under an operation condition including a plurality of steps, and wherein the control unit is configured so that a specific step of stopping the rotation of the rotor and permitting the door to be opened or closed can be set as at least one of the plurality of steps.

The above and other objects and novel features of the present invention will be apparent from the following descriptions and the drawings.

DETAILED DESCRIPTION

First Illustrative Embodiment

Figure 1:
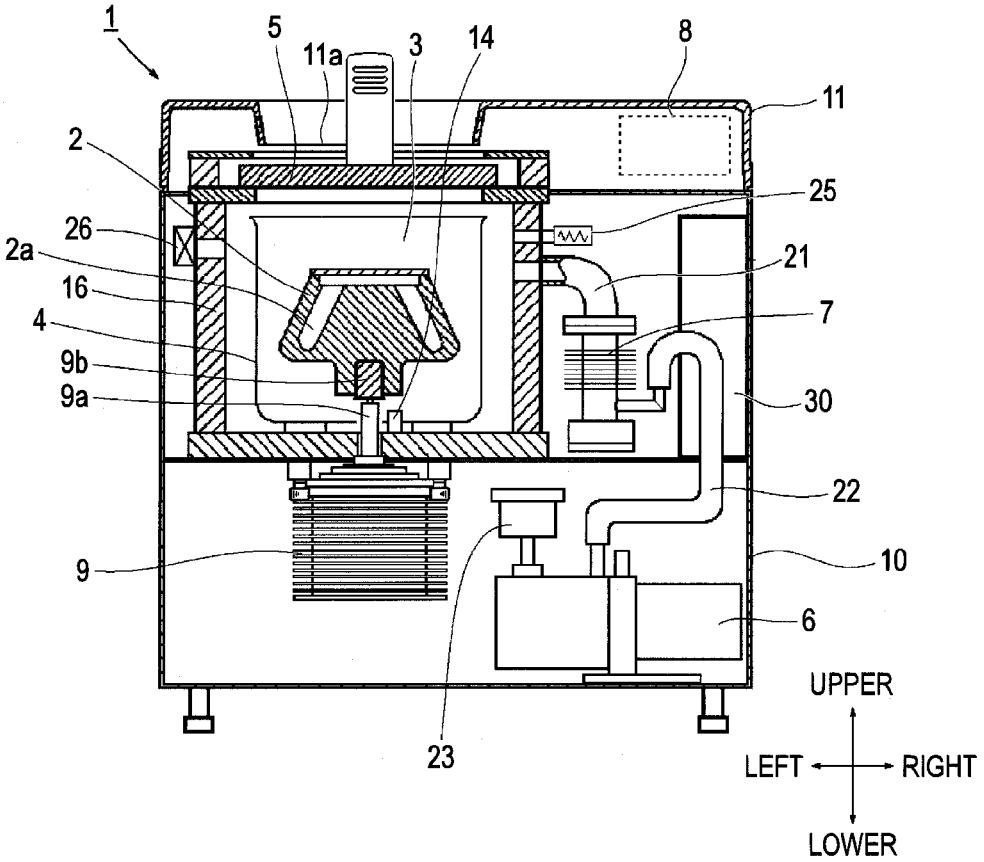
FIG. 1 is a sectional view illustrating an overall configuration of a centrifuge 1 according to an illustrative embodiment of the present invention.

A centrifuge according to illustrative embodiments of the present invention will be described with reference to the drawings. FIG. 1 is a sectional view illustrating a configuration of a centrifuge 1 according to an illustrative embodiment of the present invention. The centrifuge 1 includes a rotor 2 configured to rotate while holding therein a sample to be separated, a rotor chamber 3 configured to accommodate therein the rotor 2, a door 5 configured to open and close an opening provided to move the rotor 2 into or out of the rotor chamber 3, a sensor (not shown) for detecting an opened or closed state of the door 5, two vacuum pumps (an oil rotary vacuum pump 6 and an oil diffusion vacuum pump 7) configured to decompress the rotor chamber 3, an operation display unit 8 configured to receive a user's setting operation for centrifugal separation conditions and to display a variety of information about operating statuses and the like for a user, a motor 9 functioning as a driving unit configured to rotate the rotor 2, an openable air leak valve 26 configured to introduce air into the rotor chamber 3, a vacuum sensor 12 configured to measure a pressure in the rotor chamber 3, a temperature sensor (not shown) configured to measure a temperature of the rotor 2, a cooling device (not shown) configured to cool a bowl 4 and to indirectly control the temperature of the rotor 2, a rotor identifying sensor 14 configured to identify the mounted rotor 2 and a control device 30 configured to control the above constitutional elements.

The bowl 4 is formed at its lower part with a penetration hole communicating with an inside and an outside of the bowl 4. A rotary shaft (not shown) is configured to pass through a shaft case 9*a* extending from the motor 9 and to penetrate the penetration hole together with the shaft case 9*a*, and the rotor 2 is attached to a fitting part 9*b* of a tip of the rotary shaft. Meanwhile, the shaft case 9*a* is sealed in the penetration hole by a seal member (not shown), so that air tightness of the rotor chamber 3 can be secured. The rotor 2 is formed with a plurality of holes 2*a* for inserting tubes having a sample therein. In this illustrative embodiment, the motor 9 can operate at 150,000 revolutions per minute (rpm), for example, which is the maximum rotating speed, and the sample is centrifugally separated by a centrifugal force resulting from the rotation. In general, when the rotor 2 is rotated at high speed under atmospheric pressure, the rotor 2 generates heat due to windage loss and the high-speed rotation of the rotor 2 is suppressed by an air resistance. For this reason, when rotating the rotor 2 at high speed, it is important to evacuate the air from the rotor chamber 3 for decompression or vacuum state, thereby suppressing the windage loss.

The oil diffusion vacuum pump (DP) 7 is connected at a suction-side to the rotor chamber 3 by a vacuum piping 21 and is connected at a discharge-side to a suction port of the oil rotary vacuum pump (DR) 6 through a vacuum piping 22. The oil diffusion vacuum pump 7 is a well-known apparatus having therein a liquid oil and configured to discharge the air in the rotor chamber 3 by evaporation/condensation in the oil. In this illustrative embodiment, the oil diffusion vacuum pump 7 and the oil rotary vacuum pump 6 are connected in series, as a vacuum pump for decompressing the rotor chamber 3. A discharge-side of the oil rotary vacuum pump 6 is provided with an oil mist trap 23 for trapping oil mists contained in the exhaust air.

The control device 30 is configured to overall control the centrifuge 1 and includes a microcomputer (which will be described later) and a storage device such as a ROM, a RAM and the like. The control device 30 is configured to overall control the centrifuge 1. For example, the control device 30 is configured to input signals of the vacuum sensor 12 and a temperature sensor 13 through signal lines (not shown), to control the rotation of the motor 9, to activate and stop the oil rotary vacuum pump 6, to activate and stop the oil diffusion vacuum pump 7, to perform a cooling control on a coolant piping by controlling an operation of a compressor, to display information on the operation display unit 8, to acquire input data, to open and close the air leak valve 26, and the like.

Figure 2:
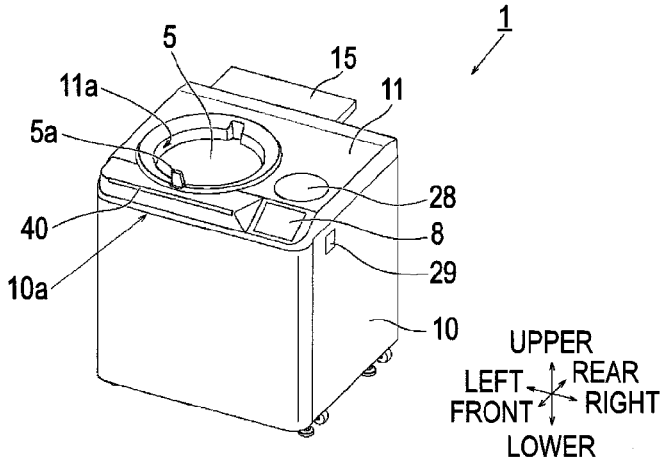
FIG. 2 is a perspective view illustrating an outward appearance of the centrifuge 1 according to the illustrative embodiment of the present invention.

FIG. 2 is a perspective view illustrating an outward appearance of the centrifuge 1 according to the illustrative embodiment of the present invention. A 'housing' of the centrifuge 1 mainly has two members, i.e., a housing main body part 10 forming front, rear, left, right and bottom surfaces and a top cover 11 configured to cover an upper surface of the housing main body part 10. The top cover 11 is formed with an opening 11*a* for access to the rotor chamber 3, and the door 5 is provided below the opening 11*a*. FIG. 2 shows a state where the rotor chamber is sealed by the door 5. In order to open the door 5, after the rotation of the rotor 2 is completely stopped, when a vacuum button 230 is pushed, the vacuum pumps 6, 7 are stopped and the air leak valve 26 (refer to FIG. 2) is released, so that the air pressure of the rotor chamber 3 becomes an atmospheric pressure. Then, the door 5 is slid from the front towards the rear with an upper end of a lever 5*a* being tilted from the front towards the rear. The top cover 11 is at its rear side with a door accommodation part 15 configured to accommodate therein the slid door 5. The right side of the opening 11*a* is attached with an elastic member 28 such as rubber, which can be used as a temporary support for a component and the like used for the centrifugal operation.

A light emitting part 40 having a predetermined horizontal width is provided at a corner part (a ridge part) on the housing upper surface of the centrifuge 1, which is located at the front side of the opening 11*a* and at which an upper part (a front side part of the top cover 11) of a coupling part 10*a* on the front surface intersects with the upper surface (the top cover 11) of the housing. The light emitting part 40 has an elongated shape of a band shape, and is configured to emit the light during the energization of the centrifuge 1, so that an overall part thereof, as seen from the outside, emits the light. Actually, although a material thereof seen from the outside does not emit the light (the light is enabled to transmit or diffuse therethrough), it seems to emit the light, as seen from the outside. A light source enabling the light emitting part 40 to emit the light can be arbitrarily implemented. In this illustrative embodiment, the light emitting part 40 is configured by a semi-transparent resin member enabling the light, which is emitted from LEDs 42 (which will be described later) arranged in the housing main body part 10, to transmit therethrough. The light emitting part 40 may be made of a transparent resin material so that the internal LEDs can be seen. However, when the light emitting part is made of a semi-transparent or white-based resin, like this illustrative embodiment, it is possible to provide a light emitting state as if it were a surface emission, and to emit the light of any color by using a color LED. In the meantime, the light emitting part 40 may be implemented using a surface-emitting device such as an EL (electroluminescence) panel and an EL illumination. Further, the light emitting part 40 may be configured to implement a light emitting pattern by the direct light or indirect light.

The operation display unit 8 is provided at the right-front side of the upper surface of the top cover 11 and at the right side of the light emitting part 40. The operation display unit 8 is a touch panel-type liquid crystal display device or EL panel, for example, and has a function as a display means (display unit) for visibly displaying information and a function as an input means (input unit) for inputting information by a user's touch operation using a finger or touch pen. In the meantime, the operation display unit 8 may be configured by an input device having input keys and a display device having no touch function, in addition to the touch panel-type liquid crystal display device. A switch unit 29 for arranging a power supply switch of the centrifuge 1 is formed at an upper part of a right side surface of the housing main body part 10. In this illustrative embodiment, the switch unit 29 is covered by a cover and the power supply switch (not shown) can be accessed by opening the cover. However, the configuration of the switch unit 29 is not limited thereto. For example, the switch unit 29 may be configured so that the power supply switch is arranged at a part recessed from an outer edge of the housing main body part 10.

Figure 3:
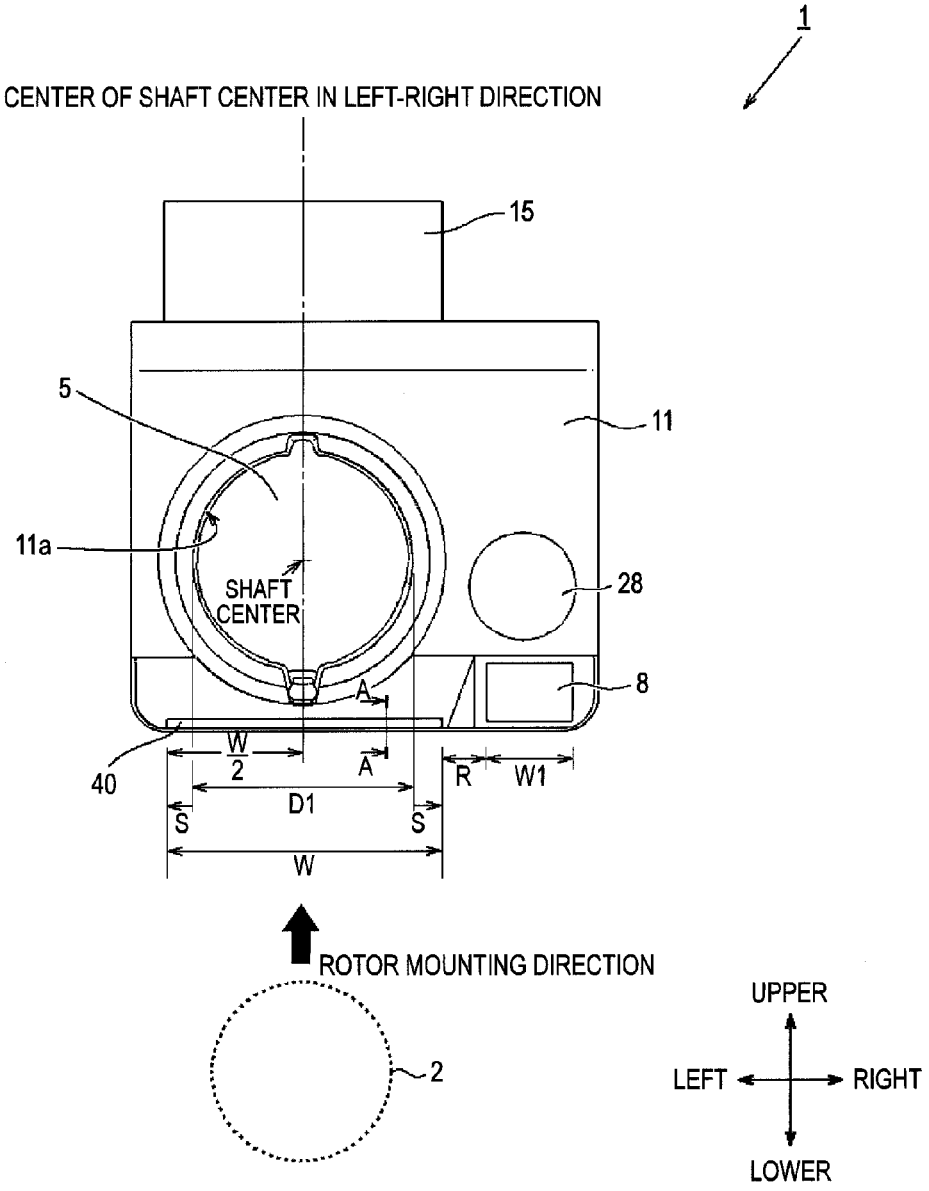
FIG. 3 is a plan view of the centrifuge 1 according to the illustrative embodiment of the present invention.

FIG. 3 is a plan view of the centrifuge 1 according to the illustrative embodiment of the present invention. It is important to arrange the light emitting part 40 at a position at which a part or all thereof can be viewed when seen from a plan view and also at a position at which a part or all of a light emission surface thereof can be viewed when seen from a front view (not shown). Here, a width W of the light emitting part 40 is configured to be sufficiently larger than a diameter D1 of the opening 11*a* of the top cover 11. At this time, the light emitting part 40 is arranged so that a line (position) of a shaft center of the rotor in the left-right direction coincides with a center line (position) of the light emitting part 40 in the left-right direction. In general, when mounting the rotor 2 into the rotor chamber 3, the user moves the rotor 2 towards the opening 11*a* from the front of the centrifuge 1, as shown with an arrow in FIG. 3. At this time, the user moves the rotor 2 into the rotor chamber 3 while passing above the light emitting part 40. The rotor 2 used in the centrifuge 1 is an integral molded product made of titanium and is about 10 to 30 kg in weight. That is, the rotor 2 does not weigh light to easily handle the same with one hand. Therefore, the user moves the rotor 2 by positioning the rotor 2 at the front of a body and securely gripping the same with two hands. At this time, when the entire light emitting part 40 emits the light over the horizontal width W of the centrifuge 1, the user can guide the rotor 2 into the rotor chamber 3 by using the light emitting position as a target. Also, a lower side of the rotor 2 is illuminated by the light emitting part 40, so that it is possible to easily see a vicinity of the lower side of the rotor 2. Therefore, it is possible to reduce concerns that the housing will collide with members provided in the vicinity of the lower end of the rotor 2, for example, an overspeed adapter, a magnetic ring configured to store the identification information of the rotor, and the like. Further, the horizontal width W of the light emitting part 40 is wider than the diameter D1 of the opening 11*a* by a width S at left and right sides, respectively. Therefore, if the user moves the rotor 2 so that partial lengths of the light emitting part 40 seen from the left and right end portions of the rotor 2 are the same at the left and right sides, when seeing the rotor 2 gripped by the user from above, it is possible to effectively guide the rotor 2 to a central position of the rotor chamber 3 in the left-right direction.

The operation display unit 8 is arranged in the vicinity of the right side of the light emitting part 40. A horizontal width W1 of the operation display unit 8 is smaller than the opening 11*a*. However, the horizontal width W of the light emitting part 40 and the horizontal width W1 are spaced by an interval R. A predetermined size of the interval R is secured, so that it is possible to effectively prevent the interference with the operation display unit 8 while mounting the rotor 2. Meanwhile, in this illustrative embodiment, as can be understood from FIG. 2, while the light emitting part 40 is formed to have a corner portion, the operation display unit 8 is obliquely arranged not to have a corner portion. Therefore, it is possible to arrange the operation display unit 8 at an angle at which the user can easily see the same. Further, since there is a space (the part corresponding to the interval R) between the operation display unit 8 and the light emitting part 40, from which the light is not emitted, it is possible to effectively prevent misidentification when using the light emitting part 40 as a positioning guide upon the mounting of the rotor 2.

Figure 4:
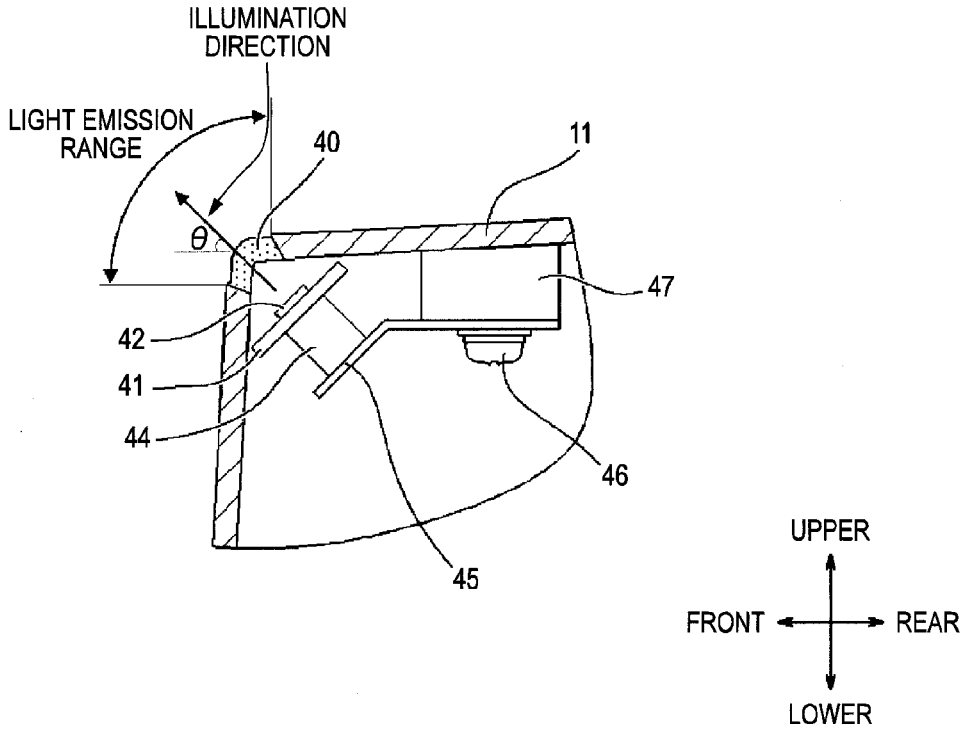
FIG. 4 is a partial sectional view taken along a line A-A of FIG. 3.

FIG. 4 is a partial sectional view taken along a line A-A of FIG. 3. In this illustrative embodiment, the light emitting part (transmissive window) 40 made of resin is provided at the corner portion of the front surface-side of the top cover 11, and the light of the LEDs 42 arranged in the housing is enabled to illuminate or diffuse to the outside through the transmission window. The light emitting part 40 may be configured (cast) integrally with the top cover 11 made of resin. Alternatively, the top cover 11 made of resin or metal may be formed with a band-shaped slit and a transmissive member made of resin may be attached to an opening of the slit. The other configuration may be also adopted. The light from the LED 42 has a high straight advance property. Therefore, when the light emitting part 40 is made of a semi-transparent synthetic resin, it is possible to appropriately diffuse the light and to implement an optimal light diffusion state so that the user's eyes are not excessively dazzled when the user sees the light emitting part 40.

The light emitting part 40 is arranged at the position ranging from the opening 11*a* of the housing to the front surface of the housing, at which a part of the light emitting part 40 can be seen both in the plan view of FIG. 3 and a front view which is not shown. In the case of a box-shaped housing, the light emitting part 40 (the transmission surface, the light diffusion surface) is preferably arranged in the vicinity of the corner portion at which the upper surface and the front surface of the housing intersect with each other, preferably on a ridge line at which the upper surface and the front surface of the housing intersect with each other. In this illustrative embodiment, a plurality of LEDs 42 is mounted on a band-shaped substrate 41, and the substrate 41 is screw-fastened to an attaching arm 45. The attaching arm 45 is fixed to an inner side of the top cover 11 by a screw 46. At this time, spacers 46, 47 are used to easily set an attaching position and an attaching angle of the substrate 41. An illumination direction of the light from the LED 42 is preferably made to face obliquely forwards. In this illustrative embodiment, the illumination direction θ of the LED 42 is set to be 45° from a horizontal plane. Since the light emitting part 40 is arranged on the ridge line of the corner portion at which the upper surface and the front surface of the housing intersect with each other, a light emitting range can be widened from a horizontal direction towards a vertical direction. Here, if the light is emitted in only the upper direction, it becomes more difficult to recognize the upper surface of the housing as the user becomes more distant from the centrifuge. Also, if the light emitting part is provided on the front surface of the housing, the light is emitted in only the forward direction, so that it becomes difficult to recognize the housing from the upper direction. However, according to the illustrative embodiment, the light emitting part 40 is arranged at the corner portion so as to be seen from the upper direction and from the front direction, so that it can be configured to be easily recognized from various directions. In the meantime, a front-rear width of the light emitting part 40 as seen from the sectional view of FIG. 4 can be arbitrarily set. However, it is preferable that the light emitting part 40 can be seen in a band shape, when the centrifuge is seen from the front side. Also, a configuration is also possible in which the shape of the light emitting part 40 is further devised and is configured as a window having a diffusion part enabling the light to be diffused in any direction, so that a lighting situation of the light source (LEDs 42) can be seen from any direction. As the diffusion part, a surface or backside of the light emitting part 40 may be formed with a jagged shape part having a triangular sectional shape to serve as a prism, so that the light illuminated from the inside can be refracted.

Figure 5:
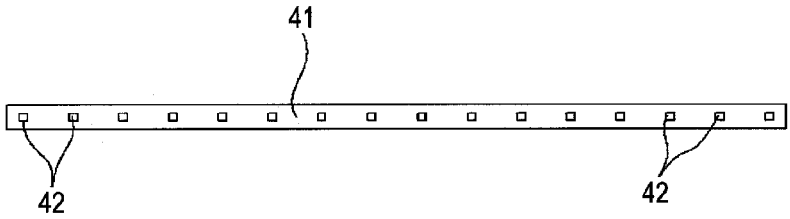
FIG. 5 is a plan view of a substrate 41 of FIG. 3.

FIG. 5 is a plan view of the substrate 41 shown in FIG. 4. Here, an example where sixteen LEDs 42 are arranged with an equal interval on the substrate 41 is shown. However, the number of the LEDs 42 is arbitrary because it is only necessary that the light emitting part 40 emits the light in a surface emitting state, not a point emitting state, by using a plurality of LEDs. The substrate 41 may be a printed board, for example. The substrate is formed thereon with a wiring (not shown), which is connected to an LED driving circuit 35 (which will be described later, refer to FIG. 6) by a lead wire (not shown). The LEDs 42 are preferably configured to change emission colors thereof. For example, 'three-color RGB LEDs', which are commercially available, may be used to emit the lights of any colors. When the LEDs 42 are configured to emit the light in the same form, an LED driver (a lighting driving circuit) can be simplified. However, a configuration is also possible in which some LEDs 42 are grouped, and the LED drivers are provided for the respective groups to light the LEDs in different display forms. Further, the LED drivers may be individually provided for each LED to implement a variety of lighting forms. In the first illustrative embodiment, one LED driver is provided for the plurality of LEDs 42 and is configured to integrally control the on/off, the emission colors, the light emitting patterns, the brightness thereof and the like.

Figure 6:
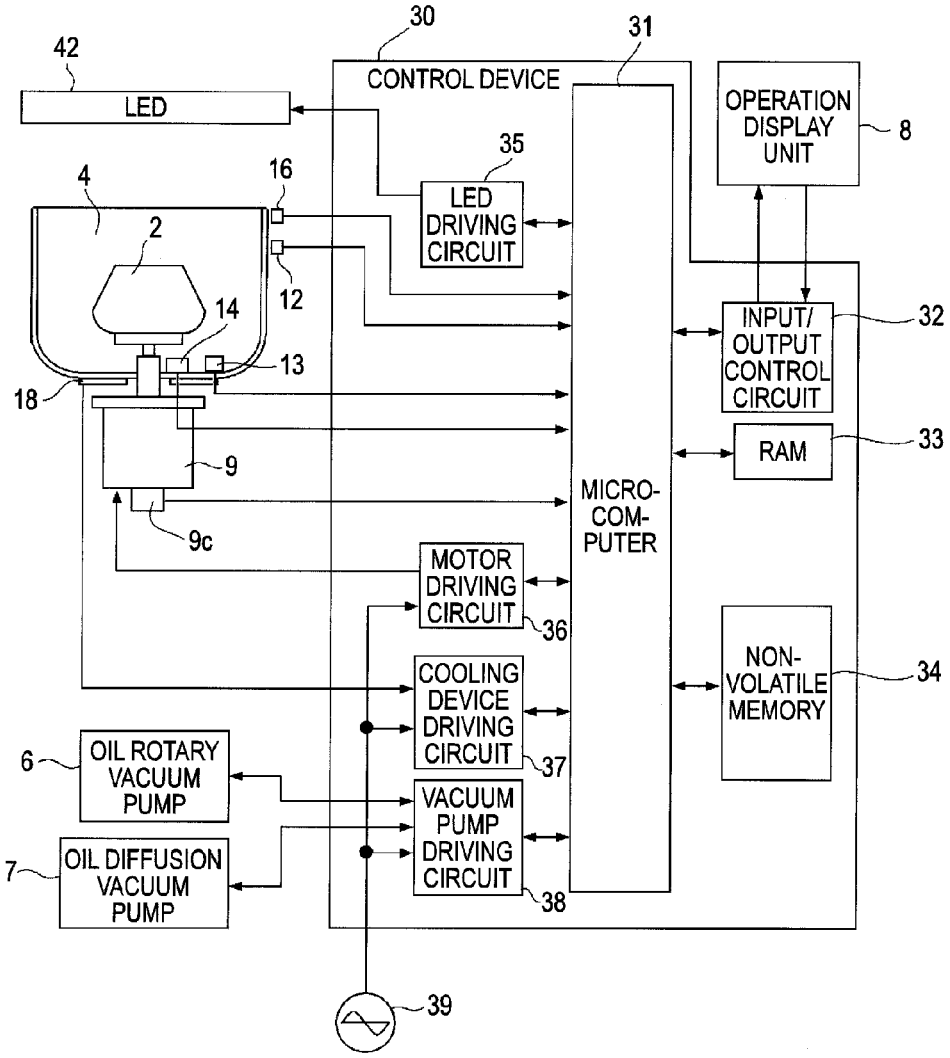
FIG. 6 is a control block diagram of the centrifuge 1 according to the illustrative embodiment of the present invention.

Subsequently, a control block diagram of the centrifuge 1 according to the illustrative embodiment of the present invention is described with reference to FIG. 6. The control device 30 has therein a microcomputer 31, a non-volatile memory 34 configured to store therein a program and control information data for operating the centrifuge, a RAM (Random Access Memory) 33 for keeping therein calculation and temporary data, an input/output control circuit 32 configured to control input and output of the operation display unit 8, which is a touch-type liquid crystal monitor, an LED driving circuit 32 configured to light the LEDs 42, a motor driving circuit 36 consisting of an inverter configured to drive the motor 9, a cooling device driving circuit 37 configured to drive a Peltier device (cooling device) for cooling the rotor, and a vacuum pump driving circuit 38 configured to drive the oil rotary vacuum pump 6 and the oil diffusion vacuum pump 7. The microcomputer 31 is connected with the temperature sensor 13 configured to measure the temperature of the rotor 2, a door sensor 16 configured to detect an opened or closed state of the door 5, the vacuum sensor 12 configured to measure a pressure in the rotor chamber 3, the rotor identifying sensor 14 configured to recognize the mounting of the rotor 2 and the identification information thereof, and a rotation sensor 9*c* configured to detect the rotation of the motor 9, of which outputs are input to the microcomputer 31. A commercial power supply 39 such as alternating current (AC) 100V or AC 200V is supplied to the motor driving circuit 36, the cooling device driving circuit 37 and the vacuum pump driving circuit 38, and the power feeding to the motor 9, the Peltier device 18, the oil rotary vacuum pump 6 and the oil diffusion vacuum pump 7 is controlled by the microcomputer 31, so that the start, stop and operations thereof are controlled. The lighting, the ON or OFF state, the emission colors, the blinking patterns, the brightness and the like of the LEDs 42 are controlled by control signals transmitted from the microcomputer 31 to the LED driving circuit 35. Since the LEDs 42 can be controlled in software manner by executing a computer program in the microcomputer 31, the microcomputer 31 can arbitrarily change the light emitting form of the LEDs 42, depending on the operating status of the centrifuge 1.

Figure 7:
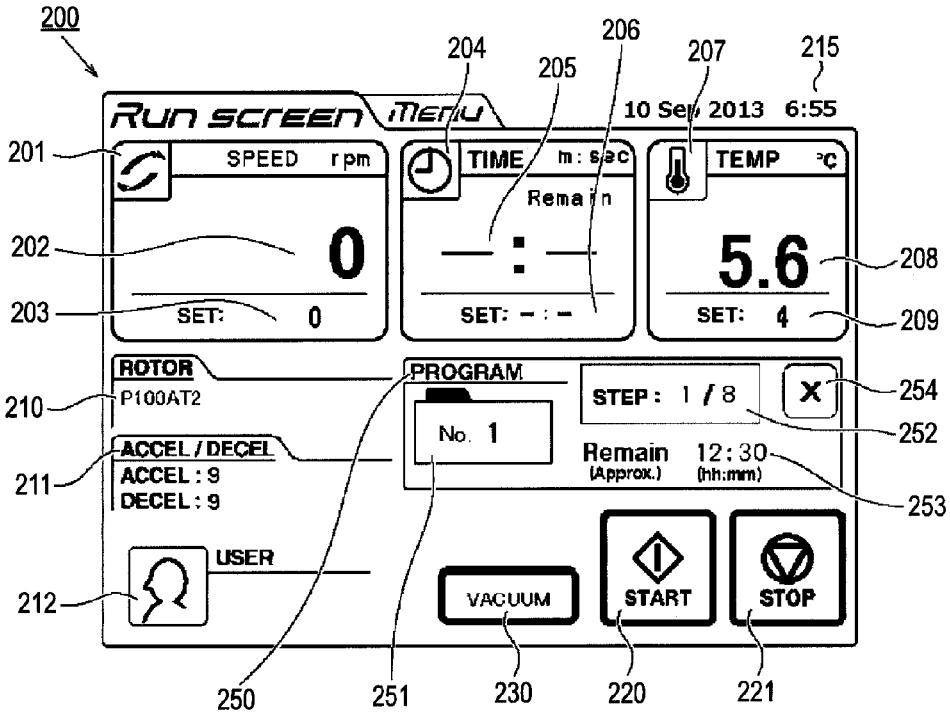
FIG. 7 illustrates a screen example on an operation display unit 8 according to the illustrative embodiment of the present invention.

Subsequently, a display example on the operation display unit 8 according to the illustrative embodiment of the present invention is described with reference to FIG. 7. A screen shown in FIG. 7 is an operation screen for setting a plurality of program operations. A screen 200 is to mainly display operating statuses and operation conditions (setting values) of the centrifuge 1. In the screen, a rotating speed display area 201, a time display area 204 and a temperature display area 207, which are the operation conditions of the centrifugal separator, are provided. Around the areas, a program operation display field 250 for displaying a current program operating status, a start button 220 for instructing a starting of the centrifugal separation operation and a stop button 221 for instructing interruption of the centrifugal separation operation or rotation stop of the motor 9 are displayed. A large number "0" at a center of the rotating speed display area 201 indicates a current rotating speed 202 of the rotor 2 and a lower end (a small letter) divided by an underlined portion indicates a set rotating speed 203. When the user touches a range of the rotating speed display area 201 with a finger, a numeric keypad screen (not shown) is popup displayed. Therefore, the user can set the rotating speed by using the numeric keypad. A large number at a center of the time display area 204 indicates an operating time (elapsed time) 205 during which the rotor 2 is actually operated with the set rotating speed 203, and is displayed in a unit of hour and minute. The operating time 205 is automatically counted and displayed using a timer function included in the microcomputer 31. A lower end (a small letter) divided by an underlined portion indicates a set operating time 206 for which the centrifugal separation is performed. A large number at a center of the temperature display area 207 indicates a current inside temperature 208 of the rotor chamber 3, and a lower end of an underlined portion indicates a set temperature 209 of the rotor 2 that should be kept during the centrifugal separation.

In a rotor display area 210, a type number of the rotor 2 to be set is displayed. An ACCEL/DECEL display field 211 indicates settings of acceleration and deceleration modes. When the user touches the field, the user can select an acceleration time within a range of 0 to 500 rpm with a number from a plurality of options as regards the acceleration mode and a deceleration time within a range of 500 to 0 rpm with a number from a plurality of options as regards the deceleration mode or select whether or not to naturally decelerate the rotor 2 from the set rotating speed. At a right-upper side of the screen 200, current day and time 215 is displayed. A vacuum button 230 is a button for activating the vacuum pumps 6, 7, which are used to lower a degree of vacuum in the rotor chamber 3 before rotating the rotor 2, or a button for stopping the vacuum pumps 6, 7 under operation and activating the air leak valve 26.

A program operation display field 250 is a display field provided to serially set a program from a step 1 (S1) of a program 01 to a step 2 (S2) of the program 01 of a second time and to display the set operating statuses. In this field, a program number 251, a step number 252 and an operation remaining time 253 indicating schematic remaining time of the program are displayed. At a right-upper side, an icon 254 for closing the program operation display field 250 is displayed. Here, when the program number 251 is touched, the display is switched to a state of FIG. 8A.

Figure 8A:
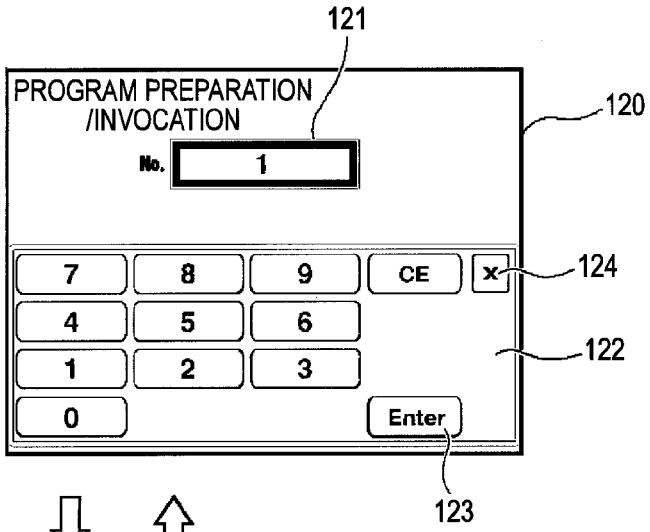
FIG. 8 (8A, 8B, 8C) illustrates a program operation setting sequence according to the illustrative embodiment of the present invention.

FIG. 8 (8A, 8B, 8C) illustrates a program operation setting sequence according to the illustrative embodiment of the present invention. In FIG. 8A, the user sets a program number. The program number described here is an identification number of a program including a series of operations (multiple operations of the program 01, stop, the program 02, stop and the program 01) indicated in the related art of FIG. 12, and includes operations from an operation of setting a specimen to be separated to an operation of picking out the specimen from the rotor chamber 3 after all the centrifugal separation operations are over. In this illustrative embodiment, steps of stopping the rotation of the rotor 2, opening the air leak valve 26 to return the pressure in the rotor chamber 3 to an atmospheric pressure and permitting the door 5 to be opened or closed can be set as one of steps of the program. In a step of permitting the door 5 to be opened or closed (here, a step of setting the rotation number of the rotor to zero (0) and permitting the door to be opened or closed is referred to as 'specific step'), the user opens and closes the door 5 to perform an operation of adding a reagent to the specimen, and the like. However, the control device 30 cannot know when the door 5 is closed and when it can proceed to a next step. Also, it is difficult to program an operating time (necessary time) in advance. Therefore, according to this illustrative embodiment, the "specific step" of permitting the door 5 to be opened or closed when the rotation number of the rotor 2 is zero (or is rotated at a predetermined low speed) is included in the series of program controls, and the registration can be made at a state where the operating time is not set to the specific step.

Figure 8B:
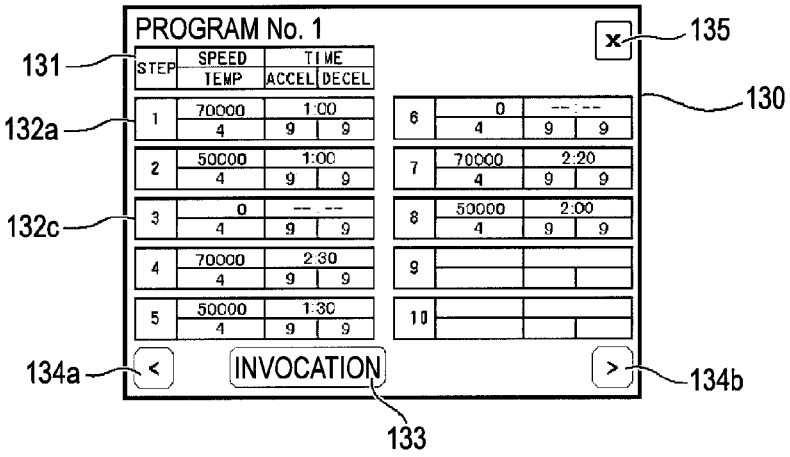
Figure 8C:
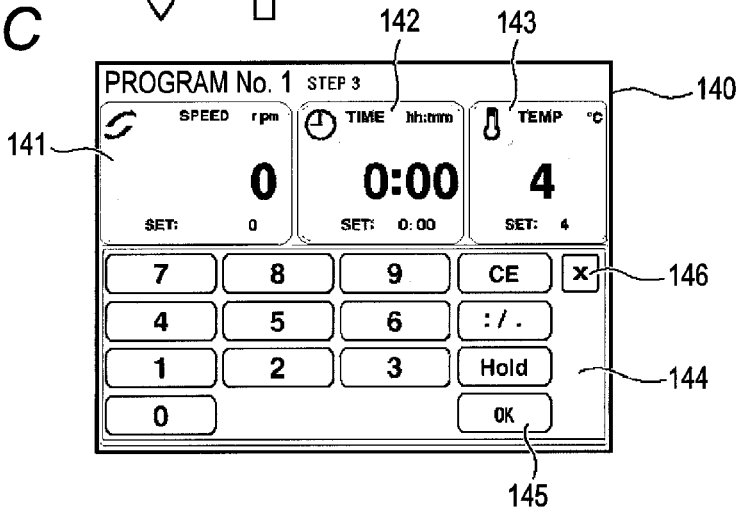

In FIG. 8A, the user inputs a number (here, "1") for identifying a program to be prepared in an input field 121. When the user touches the input field 121, a numeric keypad 122 is displayed at a lower half of a screen 120. After the user touches a desired number (here, "1"), when the user touches an enter 123 or a closing icon 124, the display is switched to a screen of FIG. 8B. FIG. 8B illustrates an input screen for defining each step in the program. In each step, 'a rotating speed of rotor (SPEED), a set temperature of rotor (TEMP), an operating time (TIME), an acceleration mode (ACCEL) and a deceleration mode (DECEL)' are set in correspondence to the step number so that they are displayed in a title field 131. For example, when the user touches a field 132*a* of step 1, the display is switched to an input screen as shown in FIG. 8C, on which the user can input a rotating speed of rotor (SPEED), a set temperature of rotor (TEMP) and an operating time (TIME). Here, when the user touches any one of a speed field 141, a time field 142 and a set temperature field 143, a numeric keypad 144 is displayed at a lower half of a screen 140. After the user touches a desired number, when the user touches an OK key 145 or a closing icon 146, the input numbers are input to the selected fields 141 to 143. Meanwhile, in FIG. 8C, the number input parts for the acceleration mode (ACCEL) and the deceleration mode (DECEL) are hidden by the numeric keypad and are thus not displayed. This is because they are automatically set as defaults. However, a configuration where it is possible to individually change the acceleration mode and the deceleration mode is preferable. After the input in FIG. 8C is completed, when the user presses a completion icon (not shown), the display is returned to the screen of FIG. 8B.

Figure 12:
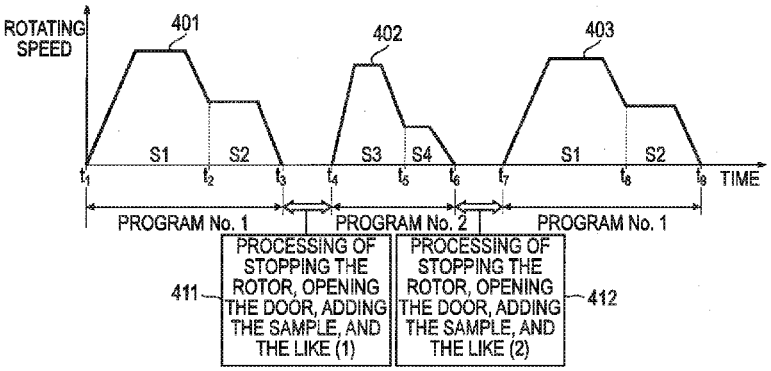
FIG. 12 illustrates an operation execution status of a plurality of programs in a centrifuge of the related art.

The steps 1 and 2 of FIG. 8B correspond to the steps 1 and 2 of the program 01 of FIG. 12. A step 3 is a specific step. In the specific step, the user sets "0" in the speed field 141 and "00:00" (or keeps a non-setting state "--:--") in the time field 142 as the operating time. When the user sets "00:00" as the setting time (TIME) in FIG. 8C, "--:--" is displayed in FIG. 8B, so that the user can know the specific step. Like this, this illustrative embodiment has a feature that the specific step in which the operating time (TIME) is not set is provided as one of the programmed steps. The execution time period of the specific step is a time period after a previous step is over until the user touches the start button 220 (refer to FIG. 7) to start the rotation of the rotor 2. Therefore, from the standpoint of the control device 30, the execution time period of the specific step is not fixed but is a variable time period that is varied by a user's operation. The user performs the input operation in the steps 1 to 8 in the same manner while shifting the screens of FIGS. 8B and 8C. From the display screen of FIG. 8B, it can be understood that the step 6 is the specific step in which the setting time is not set, like the step 3. Meanwhile, according to the centrifuge of this illustrative embodiment, it is assumed that the door 5 will be opened in the specific step. Therefore, when the specific step is set, the microcomputer 31 permits the user to operate the vacuum button 230 upon the execution of the specific step. When the vacuum button 230 is operated, the vacuum pumps 6, 7 are stopped and the air leak valve 26 is opened, so that the rotor chamber 3 returns to the atmospheric pressure. The rotor chamber 3 returns to the atmospheric pressure, so that the door 5 can be opened or closed.

Figure 9:
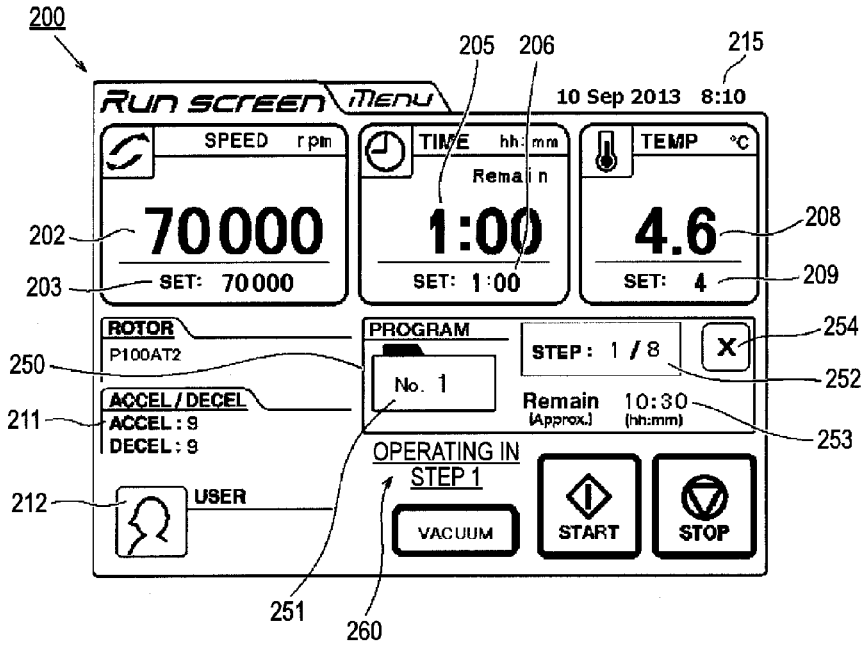
FIG. 9 illustrates a screen example on the operation display unit 8 according to the illustrative embodiment of the present invention.

Subsequently, the screen 200 that is displayed on the operation display unit 8 during the program operation of the centrifuge 1 of this illustrative embodiment is described with reference to FIG. 9. The screen displayed in FIG. 9 is substantially the same as the screen shown in FIG. 7, except that the current rotating speed 202, the actually operated operating time (elapsed time) 205 and the current rotor temperature 208 are displayed because the centrifuge 1 is being operated. This operating status indicates that the program number 251 is "1" and the step number is "first". Also, the operation conditions set in the field 132*a* of FIG. 8B are displayed in the set rotating speed 203, the set operating time 206, the set temperature 209 and the ACCEL/DECEL display field 211. In the program operation display field 250, a schematic remaining time 253 of the operation is displayed. At this time, an estimated value using an average operating time is calculated and displayed because the operating time set by the user in the steps 3 and 6 has not been decided. Here, when the user touches the field of the step number 252, the display is switched to a program operation progressing display screen 300 shown in FIG. 10.

Figure 10:
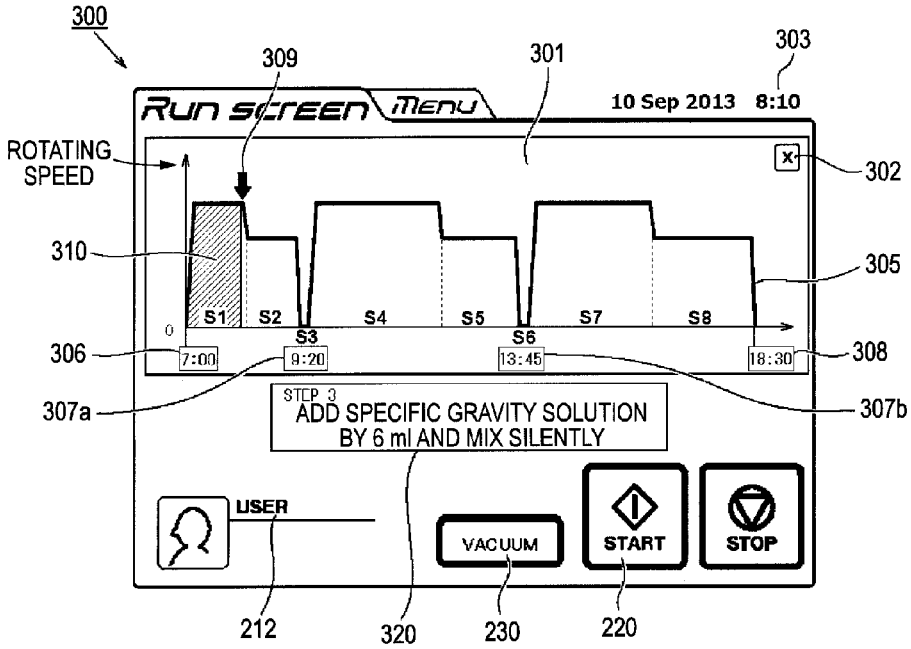
FIG. 10 illustrates a program operation progressing status screen according to the illustrative embodiment of the present invention.

FIG. 10 illustrates the program operation progressing display screen 300 according to the illustrative embodiment of the present invention. Here, a display in an upper ¾ area of the display screen of FIG. 10 has been changed. In the changed part, a graph 301 showing a relation between the rotating status of the programmed rotor and the elapsed time is displayed in a display field 301. In the display field 301, a rotating speed curve 305, the programmed steps S1 to S8 and an indicator (an arrow 309, here) showing a current progressing position are displayed. The arrow 309 is displayed to move rightwards over time. Also, a completed operation is emphasized by a hatching 310, and arrival predicted times 307*a*, 307*b* are displayed at intersection points (i.e., points at which the rotating speed of the rotor 2 becomes zero (0)) of the rotating speed curve 205 and the horizontal axis. Here, the starting time 306 of the step 1 is 7:00 (actual time). Also, the time (9:20) at which the step 2 (S2) is over is substantially correct predicted time, and the time (13:45) at which the step 5 (S5) is over is a predicted value on the assumption that the operating time of the specific step 3 is 5 minutes. An ending time 308 of the entire operation is a predicted value (estimated time) on the assumption that the operating times of the specific steps 3 and 6 are 5 minutes, respectively. The ending time 308 is largely different depending on the operation of the user in the specific steps 3 and 6. For example, if the user performs another operation upon the arrival of the specific step, the operation may be delayed. Therefore, when the start button 220 is pushed so as to activate an operation of the next step 4 in the specific step 3, the time (307*b*) and the ending time (308) are re-calculated and the arrival predicted time after the re-calculation is displayed. Like this, in the screen 300, the overall situation of the program operation is visually displayed. Therefore, the user can easily know the overall progressing and at which part the operation is being executed.

Figure 11A:
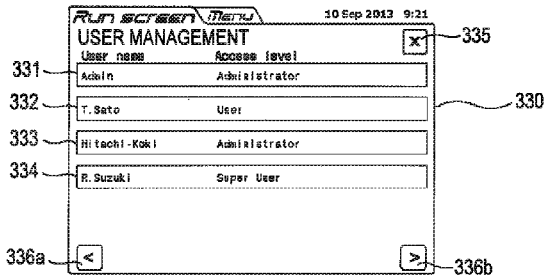
FIG. 11 (11A, 11B) illustrates a login screen according to the illustrative embodiment of the present invention.

Further, in this illustrative embodiment, an operation content ('add specific gravity solution B by 6 ml and mix silently') that is performed by the user in the next specific step (S3) is displayed in a display field 320. Like this, the arrival predicted time 307*a* of the specific step 3 (S3) and the display field 320 are displayed, so that the user can easily recognize when and what specific operation should be performed. Therefore, it is possible to implement the centrifuge of which using method is very simple. In the same manner, when the current progressing position is the step 4 (S4) to step 5 (S5), a description sentence of the operation content to be executed in the step 6 is displayed in the display field 320. Thereby, the operator can check the operation content of a specific operation on the screen 300 and move to the operation. In the meantime, the description sentence displayed in the display field 320 is preferably configured so that it can be concomitantly input when the steps 3 and 6 are designated as the specific steps on the setting screen of FIG. 8B (when the rotating speed of the rotor is zero (0) and the time setting is empty). In this way, when the execution of the steps 1 and 2 is over, the current progressing position (the arrow 309) is moved to the ending position of the step 2 (around time 9:30) and the rotation of the rotor 2 is stopped. At this time, when the user touches the vacuum button 230 so as to open the door 5, a login screen 330 of FIG. 11A is displayed. In the meantime, the information of the management of the centrifuge in the specific steps (S3, S6) (for example, the predetermined conditions, the time after the step 2 is over until the door can be opened, the time consumed in the step 3, the temperature, the degree of vacuum and the like of the rotor chamber, the vibration applied to the rotor, and the like) may be stored in the RAM 33 to leave a record, and the information that could not recorded by the user in the related art can be recorded according to the present invention. Therefore, since the series of test conditions (protocols) including the verification, in which the statuses of the steps (S3, S6) are also included, can be reproduced, it is possible to perform test of high reproducibility many times.

Figure 11B:
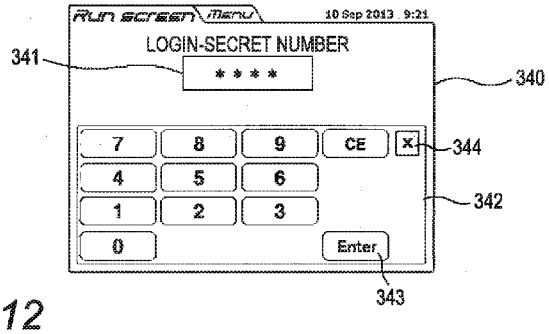

FIG. 11 (11A, 11B) illustrates a login screen according to the illustrative embodiment of the present invention. FIG. 11A shows a list of users registered in the centrifuge 1. Here, only four users are set. However, when registering more users, it is possible to register many users by selecting page switching icons 336*a*, 336*b* to switch the display. For each of the users 331 to 334, a user name and an access level are set. When the user operating the centrifuge 1 selects a corresponding user from the list, the display is shifted to a screen of FIG. 11B. In FIG. 11B, a password input field 341 and a numeric keypad 342 are displayed. When the user inputs a set secret number (password) by using the numeric keypad and selects an enter key 343, the microcomputer 31 determines whether the input password coincides. When the input password coincides, the microcomputer 31 stops the vacuum pumps 6, 7 and releases the air leak valve 26 to return the decompressed rotor chamber 3 to the atmospheric pressure, so that the door 5 can be opened or closed. Meanwhile, in a case of a centrifuge not using the vacuum pumps, the door 5 may be provided with a lock mechanism, and when the password coincides, a lock is released to open or close the door 5. This illustrative embodiment is configured so that the user is forced to perform a login process again upon the execution of the specific step. Therefore, it is possible to securely record the time at which the specific step is executed (the starting time is time at which the login is performed and the ending time is time at which the start button 220 is touched) and the operator thereof. On the other hand, a configuration where the login of FIG. 11 (11A, 11B) is not required is also possible. In this case, when the user touches the vacuum button 230, the vacuum pumps 6, 7 are immediately stopped and the air leak value 26 is opened. However, in a case where the normal step, not the specific step, is being executed, even when the user touches the vacuum button 230, no response is made. When the processing (operation) of the specific step is over, the operator covers the rotor 2 with the cover, closes the door 5 and touches the start button 220. At this time, the microcomputer 31 is configured to check whether the door 5 is securely closed by the output of the door sensor 16 and to start a next step only when the door 5 is closed. When the door 5 is not closed, the microcomputer 31 displays a message 'please close the door and then press the start button' on the operation display unit 8, in addition to a warning such as an alarm sound.

In this way, when all steps of the program operation of the centrifuge 1 are normally over, the microcomputer 31 displays and blinks a message 'all processes are over' on the operation display unit 8 and turns on or blinks the light emission unit 40 with a specific color. At this time, an acoustic attention such as a melody alarm may be also made.

Although the present invention has been described with reference to the illustrative embodiment, the present invention is not limited to the illustrative embodiment and can be variously changed without departing from the scope of the present invention. For example, in the above illustrative embodiment, the operating time is not set in the specific time. However, a time limit (for example, 10 minutes) or temporary setting time may be provided. In a case of the normal step, the specific step may be shifted to a next step when the setting time elapses, and in a case of the specific step, the specific step may be shifted to a next step when the start button 220 is pushed and the door is closed. In this case, it is possible to calculate the arrival predicted time or ending predicted time of the specific time more precisely by using the time limit or temporary setting time.

The present invention provides illustrative, non-limiting examples as follows:

(1) A centrifuge including: a rotor; a rotor chamber accommodating therein the rotor and having an opening; a motor configured to rotate the rotor; a door configured to close the opening of the rotor chamber; an input unit configured to receive an input of an operation condition; a display unit configured to display an operating status; and a control unit configured to control rotation of the motor, wherein the control unit is configured to perform a program operation under an operation condition including a plurality of steps, and wherein the control unit is configured so that a specific step of stopping the rotation of the rotor and permitting the door to be opened or closed can be set as at least one of the plurality of steps.

Accordingly, since the specific step can be set in this way, the operations of the related art where a user manually invokes a plurality of programs and completes a series of centrifugal separation operations can be collectively programmed. Thereby, it is possible to implement a centrifuge in which an operating error is difficult to occur and which can be easily used.

(2) The centrifuge according to (1), wherein operating times of centrifugal separations are set to each of the plurality of steps other than the specific step, and wherein the operating time is not set to the specific step, and the specific step is configured to shift to a next step when the input unit receives an operation resuming instruction from a user.

(3) The centrifuge according to (2), further including a sensor configured to detect an opened or closed state of the door, wherein the control unit is configured to check the opened or closed state of the door from an output of the sensor when the operation resuming instruction is received, and wherein the control unit is configured to starts executing the next step when the door is closed.

Accordingly, in steps (normal steps) other than the specific step, it is required to set the operating time in the steps. However, in the specific step, since the necessary time is varied by a user's operation, the user is not forced to specify the operating time. When a user's operation resuming instruction is received through the input unit (for example, a start button is pressed), it is checked whether the door is opened or closed, and when it is confirmed that the door is closed, the specific step is shifted to a next step.

(4) The centrifuge according to (2) or (3), wherein the control unit is configured to display an execution status of the step on the display unit, and wherein the control unit is configured to display a description of an operation that should be performed by a user on the display unit during execution of the specific step.

(5) The centrifuge according to any one of (1) to (4), further including a vacuum pump configured to decompress the rotor chamber, wherein the control unit is configured to permit a user to perform a decompression operation of the rotor chamber in the specific step.

(6) The centrifuge according to (5), wherein a graph of which a horizontal axis is a time axis and a vertical axis indicates a rotation number of the rotor is configured to be displayed on the display unit, and a portion where the operation has completed is configured to be distinctively displayed in the graph.

Accordingly, the control unit is configured to visually display an execution status of the step with a number, graph, etc., on the display unit and to display a description of an operation that should be performed by the user on the display unit, just before the specific step is executed or during the execution of the specific step. When the centrifuge has a vacuum pump configured to decompress the rotor chamber, the user is permitted to perform the decompression operation of the rotor chamber in the specific step. Therefore, the operator can stop the vacuum pump and open the door in the specific step. During the operation of the centrifugal separation, the graph of which a horizontal axis is a time axis and a vertical axis indicates a rotation number of the rotor is displayed on the display unit, and a portion where the operation has completed is distinctively (for example, a hatching) displayed in the graph, so that the operation completed part is visually displayed.

(7) The centrifuge according to (6), wherein the control unit is configured to predict an ending time at which execution of all steps including the specific step is over, and wherein the control unit is configured to display the ending time on the display unit during the operation of the centrifuge.

The time required to execute the specific step may be predicted using a standard operating time. For example, when adding a reagent to a specimen container of a specific rotor, the time consumed to end the entire step is calculated by using, for example, the operating time "5 minutes".

(8) The centrifuge according to (7), wherein during the operation, the control unit is configured to update the ending time by reflecting an actual time consumed in the specific step which has completed and to display the same on the display unit.

Accordingly, since the actually measured value is sequentially reflected in accordance with the operation progressing status, the user can know the operation ending time of which precision is high.

(9) The centrifuge according to (8), wherein during the operation, the control unit is configured to display a starting time of the specific step to be executed thereafter on the display unit.

Accordingly, the user can easily know a starting time of a next step by seeing the display unit.

(10) The centrifuge according to any one of (1) to (9), wherein the control unit is configured to request a user that will open or close the door to perform a login process when shifting to the specific step, and is configured to record information of the user having performed the login process in a storage device (a hard disk drive, a card memory device and the like).

By the login process, it is possible to prevent an unauthorized user from erroneously operating the specific step and to securely record the user who has performed the operation and when the operation has been performed. Therefore, it is possible to acquire and manage the correct operation recording.

According to the above-described aspects, it is possible to manage all the processes of the centrifugal separation with one program. Also, by the user only pressing the start button until the operation of the programmed steps is over, it is possible to perform the centrifugal separation operation including an operation for a specimen, which requires the stop of the rotor during the operation of the centrifuge. Also, it is possible to effectively prevent an error of selecting and executing an erroneous program after the "operation accompanied with the opening or closing of the door", which is performed in the specific step, and to provide a new operating method of the program operation for the user. Also, since the progressing status of the program operation is displayed on a display screen, the user can easily know a timing at which a specific operation should be performed. Further, since a guidance indicating the content of the specific operation is displayed on the display unit, it is possible to remarkably reduce an error of in the contents of the specific operation, which may be caused by the user.

What is claimed is:

1. A centrifuge comprising:

a rotor;

a rotor chamber accommodating therein the rotor and having an opening;

a motor configured to rotate the rotor;

a door configured to close the opening of the rotor chamber;

an input unit configured to receive an input of an operation condition;

a display unit configured to display an operating status; and a control unit configured to control rotation of the motor, wherein the control unit is configured to perform a single program operation under an operation condition including a plurality of steps, wherein the plurality of steps have two or more centrifuging steps of centrifugal separation and a specific single step of stopping the rotation of the rotor and concurrently permitting the door to be opened or closed, and wherein the specific single step is set between the centrifuging steps.

2. The centrifuge according to claim 1, wherein operating times of centrifugal separations are set to each of the plurality of steps other than the specific single step, and wherein a stopping time is not set to the specific single step, and the specific single step is configured to shift to a next centrifuging step when the input unit receives an operation resuming instruction from a user.

3. The centrifuge according to claim 2, further comprising a sensor configured to detect an opened or closed state of the door, wherein the control unit is configured to check the opened or closed state of the door from an output of the sensor when the operation resuming instruction is received, and wherein the control unit is configured to start executing a next centrifuging step when the door is closed.

4. The centrifuge according to claim 2, wherein the control unit is configured to display an execution status of the step on the display unit, and wherein the control unit is configured to display a description of an operation that should be performed by a user on the display unit during execution of the specific single step.

5. The centrifuge according to any claim 1, further comprising a vacuum pump configured to decompress the rotor chamber, wherein the control unit is configured to permit a user to perform a decompression operation of the rotor chamber in the specific single step.

6. The centrifuge according to claim 5, wherein a graph of which a horizontal axis is a time axis and a vertical axis indicates a rotation number of the rotor is configured to be displayed on the display unit, and a portion where the operation has completed is configured to be distinctively displayed in the graph.

7. The centrifuge according to claim 6, wherein the control unit is configured to predict an ending time at which execution of all steps including the specific single step is over, and wherein the control unit is configured to display the ending time on the display unit during the operation of the centrifuge.

8. The centrifuge according to claim 7, wherein during the operation, the control unit is configured to update the ending time by reflecting an actual time consumed in the specific single step which has completed and to display the same on the display unit.

9. The centrifuge according to claim 8, wherein during the operation, the control unit is configured to display a starting time of the specific single step to be executed thereafter on the display unit.

10. The centrifuge according to claim 1, wherein the control unit is configured to request a user that will open or close the door to perform a login process when shifting to the specific single step, and is configured to record information of the user having performed the login process in a storage device.

11. A centrifuge comprising:

a rotor;

a rotor chamber accommodating therein the rotor and having an opening;

a motor configured to rotate the rotor;

a door configured to close the opening of the rotor chamber;

an input unit configured to receive an input of an operation condition;

a display unit configured to display an operating status; and a control unit configured to control rotation of the motor, wherein the control unit is configured to perform a program operation under an operation condition including a plurality of steps, wherein the control unit is configured so that a specific step of stopping the rotation of the rotor and permitting the door to be opened or closed can be set as at least one of the plurality of steps, wherein operating times of centrifugal separations are set to each of the plurality of steps other than the specific step, wherein the operating times are not set to the specific step, and the specific step is configured to shift to a next step when the input unit receives an operation resuming instruction from a user, and wherein the control unit is configured to display an execution status of the step on the display unit, and wherein the control unit is configured to display a description of an operation that should be performed by a user on the display unit during execution of the specific step.

12. A centrifuge comprising:

a rotor;

a rotor chamber accommodating therein the rotor and having an opening;

a motor configured to rotate the rotor;

a door configured to close the opening of the rotor chamber;

an input unit configured to receive an input of an operation condition;

a display unit configured to display an operating status;

a vacuum pump configured to decompress the rotor chamber; and a control unit configured to control rotation of the motor, wherein the control unit is configured to perform a program operation under an operation condition including a plurality of steps, wherein the control unit is configured so that a specific step of stopping the rotation of the rotor and permitting the door to be opened or closed can be set as at least one of the plurality of steps, and wherein the control unit is configured to permit a user to perform a decompression operation of the rotor chamber in the specific step.

* * * * *